US011139607B2

(12) United States Patent
Kawashima et al.

(10) Patent No.: US 11,139,607 B2
(45) Date of Patent: Oct. 5, 2021

(54) CONNECTOR WITH INNER AND OUTER HOUSINGS AND A COVER, WITH THE COVER AND THE INNER HOUSING BEING INDEPENDENTLY SEPARABLE FROM THE OUTER HOUSING WHILE THE CONNECTOR IS CONNECTED TO A MATING CONNECTOR

(71) Applicant: Sumitomo Wiring Systems, Ltd., Mie (JP)

(72) Inventors: Naomichi Kawashima, Mie (JP); Tomohiko Kobayashi, Mie (JP); Yutaro Yoshida, Mie (JP); Masatoshi Ito, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/761,525

(22) PCT Filed: Nov. 6, 2018

(86) PCT No.: PCT/JP2018/041112
§ 371 (c)(1),
(2) Date: May 5, 2020

(87) PCT Pub. No.: WO2019/093301
PCT Pub. Date: May 16, 2019

(65) Prior Publication Data

US 2020/0274285 A1 Aug. 27, 2020

(30) Foreign Application Priority Data

Nov. 8, 2017 (JP) ..... JP2017-215624

(51) Int. Cl.
*H01R 13/506* (2006.01)
*H01R 13/52* (2006.01)
(Continued)

(52) U.S. Cl.
CPC ..... *H01R 13/506* (2013.01); *H01R 13/5213* (2013.01); *H01R 13/5219* (2013.01);
(Continued)

(58) Field of Classification Search
CPC ..... H01R 13/506; H01R 13/5213; H01R 13/5219; H01R 13/6272; H01R 13/6273; H01R 13/639
See application file for complete search history.

(56) References Cited

U.S. PATENT DOCUMENTS 6,190,203 B1 2/2001 Murakami et al.
6,582,256 B2 * 6/2003 Sakurai ..... H01R 13/518 439/701
(Continued)

FOREIGN PATENT DOCUMENTS

JP 2001-133369 5/2000
JP 2002-083646 3/2002
(Continued)

OTHER PUBLICATIONS

International Search Report dated Jan. 29, 2019.

*Primary Examiner* — Tho D Ta
(74) *Attorney, Agent, or Firm* — Gerald E. Hespos; Michael J. Porco; Matthew T. Hespos

(57) ABSTRACT

A connector (1) is provided with an inner housing (20) to be fit to an inner periphery of a mating housing (M) and an outer housing (30) fittable to an outer periphery of the mating housing (M). The outer housing (30) is held on the inner housing (20) by first locks (50) before connection to the mating housing (M), is held connected to the mating housing (M) by a second lock (60) at the time of connection to the mating housing M, and is separated from the inner
(Continued)

housing (20) and held connected to the mating housing (M) by releasing the first locks (50) at the time of separation from the mating housing (M).

6 Claims, 12 Drawing Sheets

(51) Int. Cl.
*H01R 13/627* (2006.01)
*H01R 13/639* (2006.01)

(52) U.S. Cl.
CPC ..... *H01R 13/6272* (2013.01); *H01R 13/6273* (2013.01); *H01R 13/639* (2013.01)

(56) References Cited

U.S. PATENT DOCUMENTS

| | | | | |
|---|---|---|---|---|
| 6,623,309 | B2 * | 9/2003 | Sakurai | H01R 13/518 439/364 |
| 7,125,290 | B2 * | 10/2006 | Martin | H01R 13/6271 439/701 |
| 2002/0031933 | A1 | 12/2002 | Nakamura | |
| 2017/0012388 | A1 | 1/2017 | Sasaki | |

FOREIGN PATENT DOCUMENTS

| | | |
|---|---|---|
| JP | 2006-344/175 | 12/2006 |
| JP | 2013-182749 | 9/2013 |
| JP | 2017-016963 | 1/2017 |
| WO | 2013/128848 | 9/2013 |

* cited by examiner

CONNECTOR WITH INNER AND OUTER HOUSINGS AND A COVER, WITH THE COVER AND THE INNER HOUSING BEING INDEPENDENTLY SEPARABLE FROM THE OUTER HOUSING WHILE THE CONNECTOR IS CONNECTED TO A MATING CONNECTOR

BACKGROUND

Field of the Invention

This specification relates to a connector.

Related Art

Japanese Unexamined Patent Publication No. 2006-344475 discloses a waterproof connector including a male housing and a female housing. This waterproof connector is intended to be used in a vehicle or the like. The male housing of this waterproof connector is provided with a small receptacle and male terminals are accommodated inside the small receptacle, whereas the female housing is provided with a tower and female terminals are accommodated inside the tower. The tower of the female housing is fit into the small receptacle of the male housing. Thus, the female terminals and the male terminals respectively accommodated in the tower and the small receptacle contact each other to be properly connected.

Further, a large receptacle is provided around the tower of the female housing and is to be fit tightly on the exterior of the small receptacle of the male housing. The large receptacle is provided to guide the small receptacle to a proper connection position to the tower when connecting the male housing and the female housing. This guiding function is intended to suppress the fretting wear of the terminals due to vibration during the use of the connector and to prevent foreign matter from entering at connected positions of the terminals.

However, if such a connector is disposed around a tire or the like of a vehicle, foreign matter, such as mud from outside, adheres to an outer surface of the large receptacle. If the male housing is pulled out from the female housing at the time of maintenance or the like in this state, the mud adhering to the large receptacle moves to a part of the outer peripheral surface of the small receptacle covered with the large receptacle. As a result, a fitting force for the small receptacle and the large receptacle increases, and insertion and removal become difficult when connecting the male housing and the female housing again.

SUMMARY

A connector disclosed in this specification includes an inner housing to be fit to an inner periphery of a mating housing, and an outer housing fittable to an outer periphery of the mating housing. The outer housing is held on the inner housing by a first lock before connection to the mating housing, is held connected to the mating housing by a second lock at the time of connection to the mating housing, and is separated from the inner housing and held connected to the mating housing by releasing the first lock at the time of separation from the mating housing.

If the outer housing is separated from the mating housing, foreign matter adheres to a fitting part of the outer housing and the mating housing. Thus, a connection force increases when connecting the outer housing and the mating housing again. However, the outer housing is kept connected to the mating housing according to the above configuration. Therefore, the adhesion of foreign matter is prevented, and there is no increase of the connection force.

Further, the inner housing is fit to the inner periphery of the mating housing while being isolated from outside by both the mating housing and the outer housing that is fit to the outer periphery of the mating housing. Thus, even if foreign matter is not adhering to the inner housing (unlike the outer housing) and only the inner housing is removed from the inner peripheral side of the mating housing for maintenance or the like, the foreign matter is unlikely to adhere to the inner housing. Thus, the insertion and removal of the inner housing into and from the mating housing can be repeated without an increase of connection force caused by the adhesion of foreign matter to the inner housing.

The inner housing of one embodiment includes a terminal accommodating portion that is to be fit in the mating housing. A sealing ring is provided on an outer periphery of the terminal accommodating portion and is capable of contacting an inner periphery of the mating housing when the terminal accommodating portion is fit in the mating housing. A rear wall is coupled to the terminal accommodating portion and is to be disposed outside the mating housing. Thus, the outer housing collectively covers the mating housing and the rear wall. According to this configuration, the outer housing collectively covers the mating housing and the rear wall of the inner housing disposed outside the mating housing. Thus, a route of foreign matter from outside to the sealing ring becomes longer and the amount of the foreign matter accumulated near the sealing ring can be reduced.

A cover may collectively cover the inner housing and the outer housing. The second lock includes a through hole provided on a side of the outer housing forward of the sealing ring in a connecting direction to the mating housing and is capable of locking the mating housing. The cover includes a ceiling wall having a closing portion for covering the through hole and a releasing hole that penetrates through the ceiling wall at a position forward of the closing portion in the connecting direction. The releasing hole enables locking between the mating housing and the through hole to be released.

According to this configuration, the through hole of the second lock is covered by the closing portion of the cover and cannot be hand-touched from outside. Thus, the second lock cannot be released inadvertently. Further, the through hole is covered by the closing portion. Accordingly, there is no route of foreign matter from outside to intrude to the sealing ring, and the amount of the foreign matter accumulated near the sealing ring can be reduced even more. Further, the releasing hole that enables locking with the mating housing to be released is provided forward of the closing portion in the connecting direction. Therefore, even if foreign matter from outside intrudes through the releasing hole, a route to the sealing ring becomes longer so that intrusion of the foreign matter can be suppressed.

According to the invention disclosed in this specification, it is possible to provide a connector that does not require an increased connection force even if the connector is repeatedly inserted into and withdrawn from a mating housing adhered with foreign matter.

DETAILED DESCRIPTION

First Embodiment

A first embodiment is described with reference to FIGS. 1 to 11.

Figure 1:
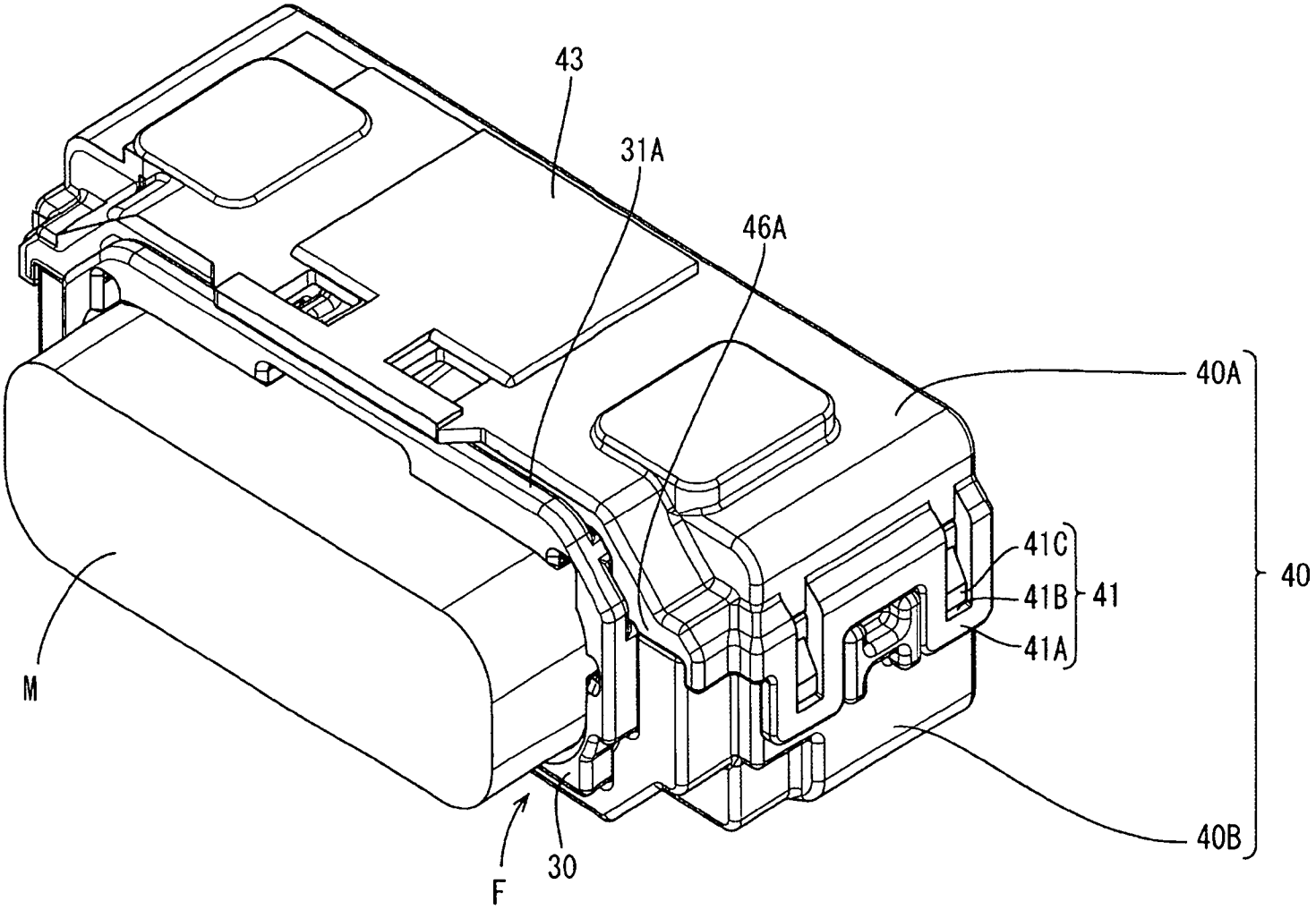
FIG. 1 is a perspective view showing a connector according to a first embodiment.
Figure 2:
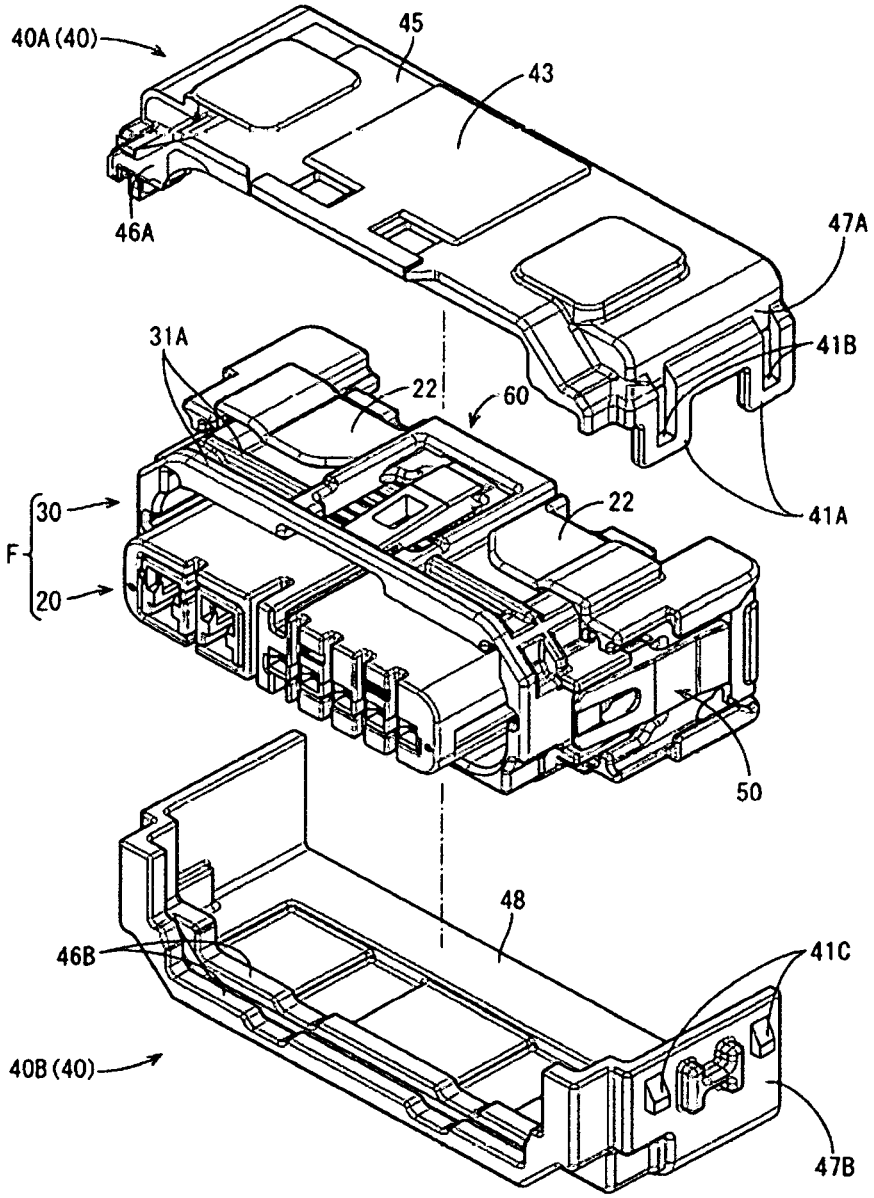
FIG. 2 is a perspective view showing a state where a cover member is removed.

A female connector 1 (an example of a connector) of this embodiment is electrically connected to a mating connector by being fit into a housing (hereinafter, referred to as a "mating housing M") of the mating connector and is used in an environment in which foreign matter is present (e.g. around a tire of a vehicle). The female connector 1 has a substantially rectangular parallelepiped shape somewhat flat as a whole, as shown in FIG. 1, and includes a cover member 40 for covering a female housing F, as shown in FIG. 2. Note that, in the following description, a left-upper side, a right-lower side and an upper side in FIG. 1 are referred to respectively as a front side, a right side and an upper side.

Figure 3:
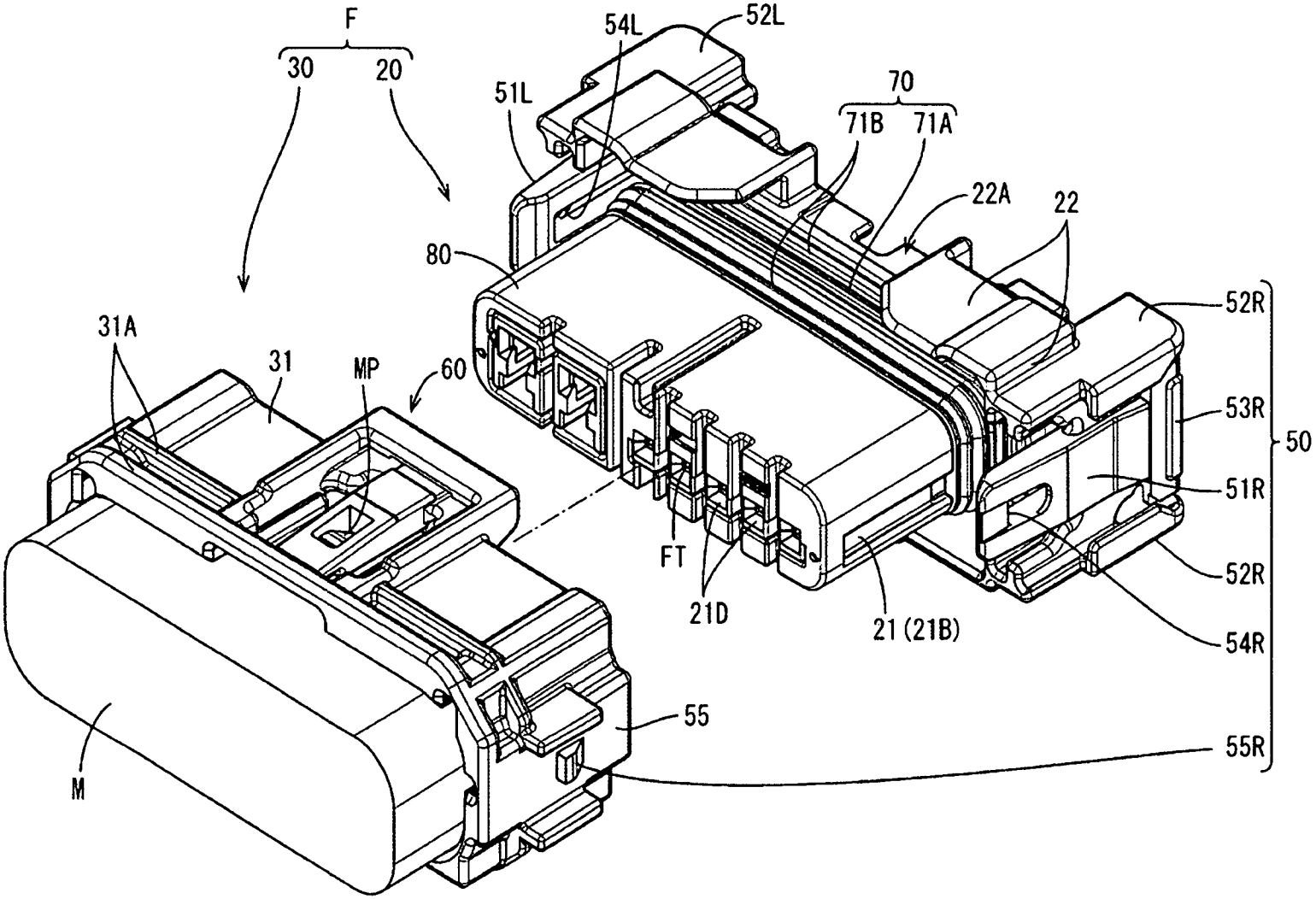
FIG. 3 is a perspective view showing a state where locking by first lock portions is released.

As shown in FIG. 3, the female housing F is composed of an inner housing 20 and an outer housing 30 disposed on an outer peripheral side of the inner housing 20. As shown in FIG. 2, the inner housing 20 and the outer housing 30 are held integrally by first locks 50 provided on the inner housing 20 and the outer housing 30. As shown in FIG. 3, the outer housing 30 can be removed from the inner housing 20 by releasing the first locks 50.

Figure 4:
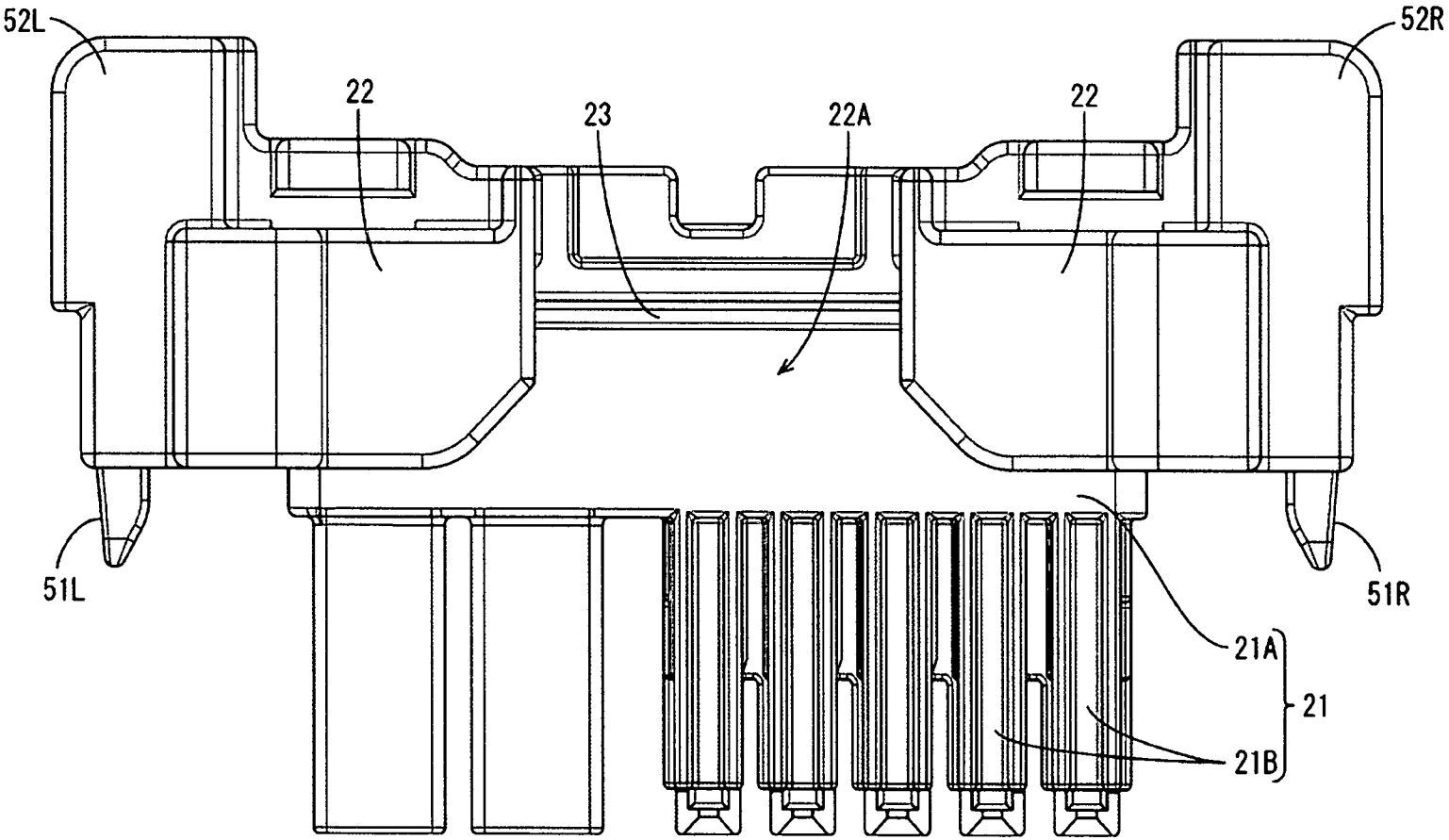
FIG. 4 is a plan view showing an inner housing.
Figure 5:
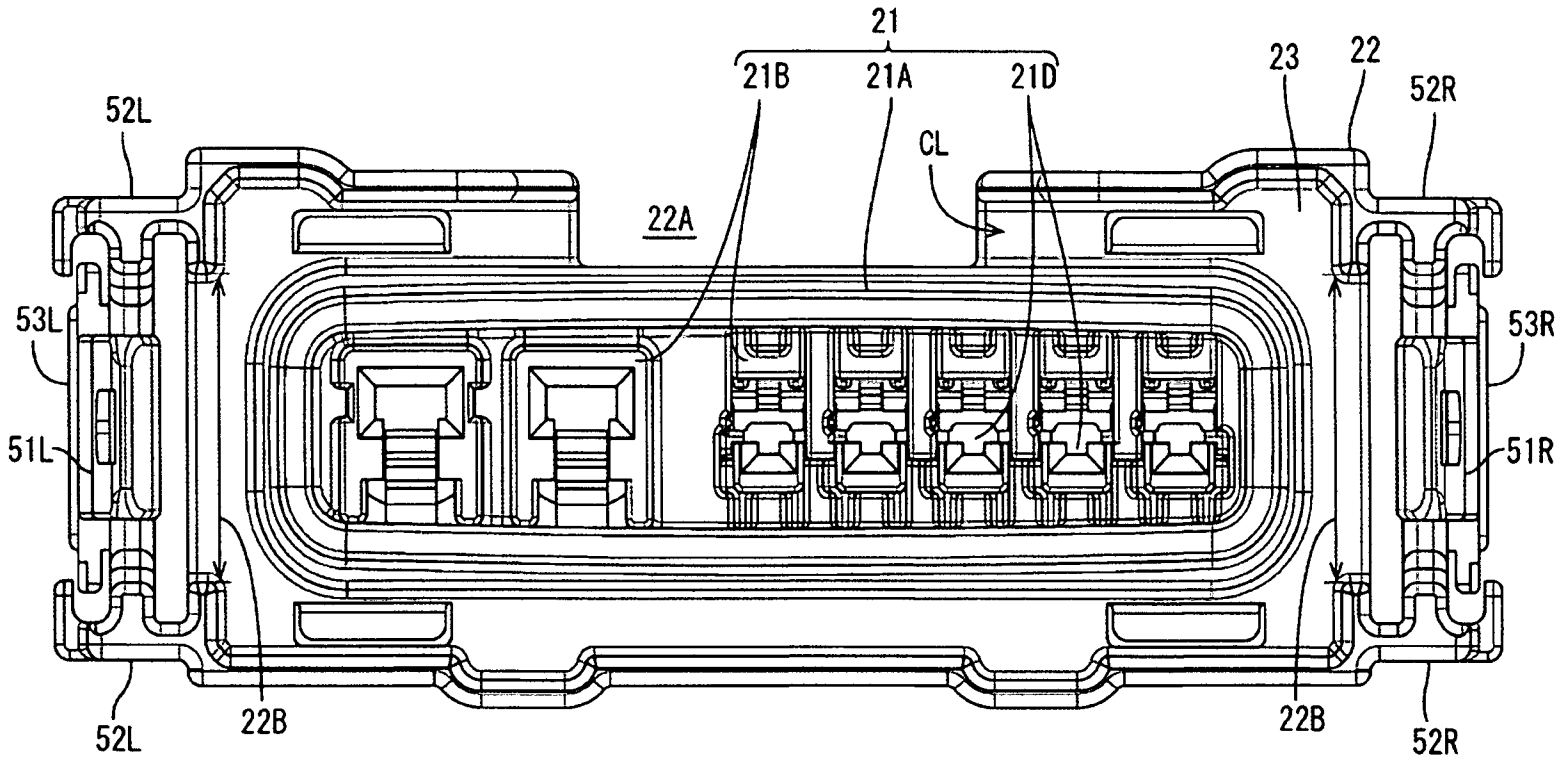
FIG. 5 is a front view showing the inner housing.
Figure 6:
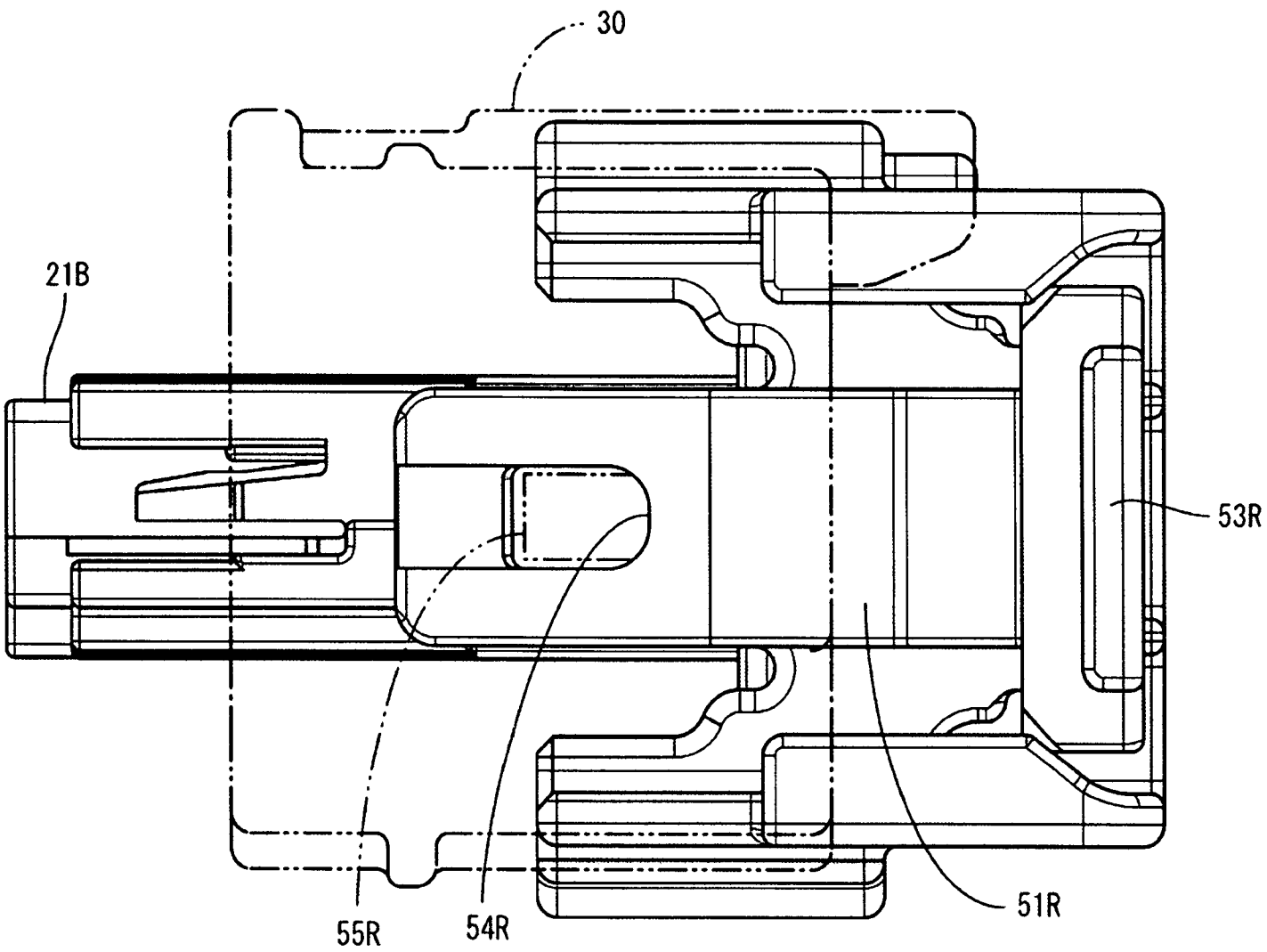
FIG. 6 is a side view showing the inner housing.

As shown in FIGS. 4 and 5, the inner housing 20 includes a rear wall 23, a terminal accommodating portion 21 disposed in a central part of the rear wall 23 and having a wide flat shape, and a rear receptacle 22 disposed on an outer peripheral side of the terminal accommodating portion 21 and to be fit to an outer periphery of the outer housing 30.

Figure 10:
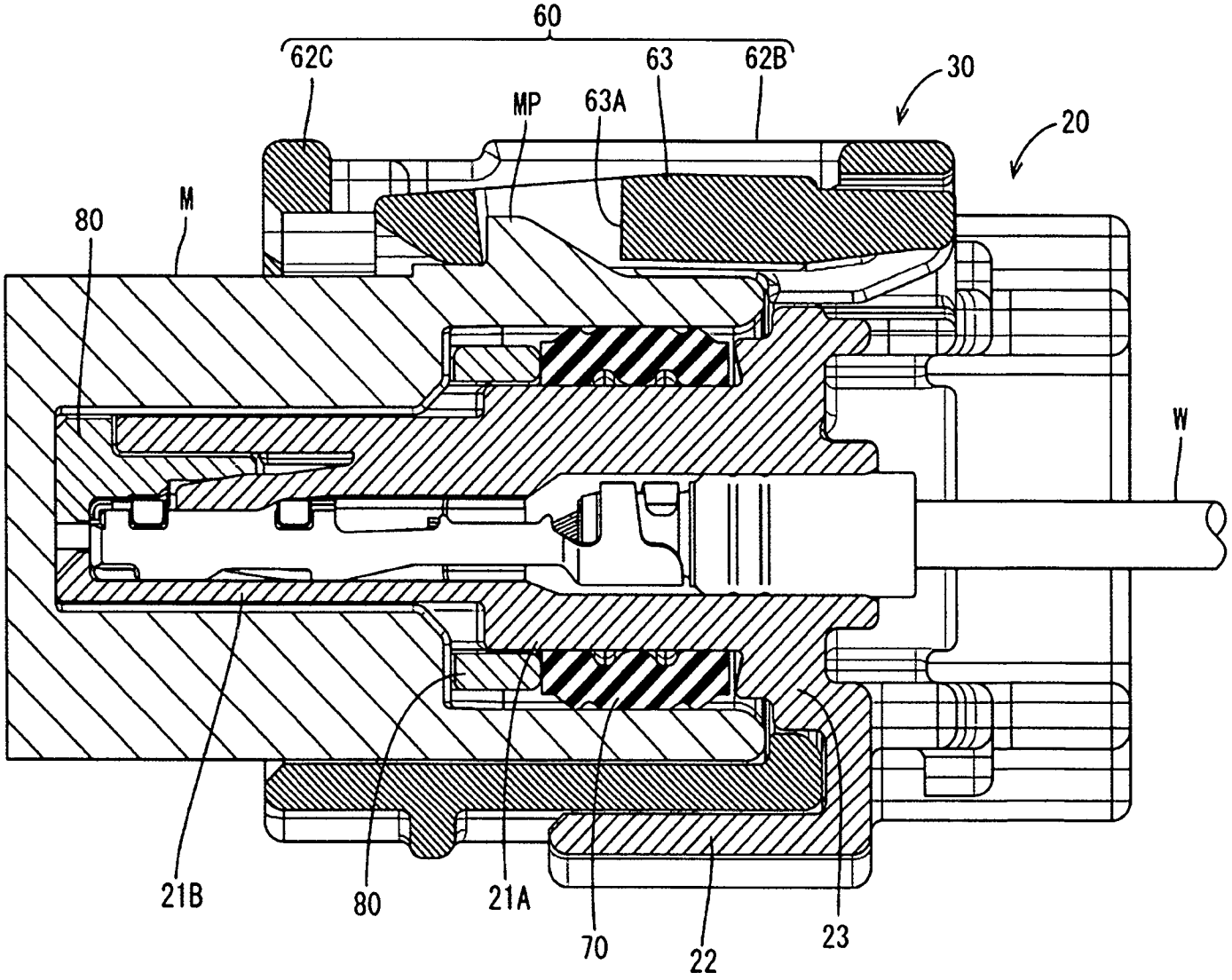
FIG. 10 is a section showing the state where the female housing and the mating housing are connected.
Figure 11:
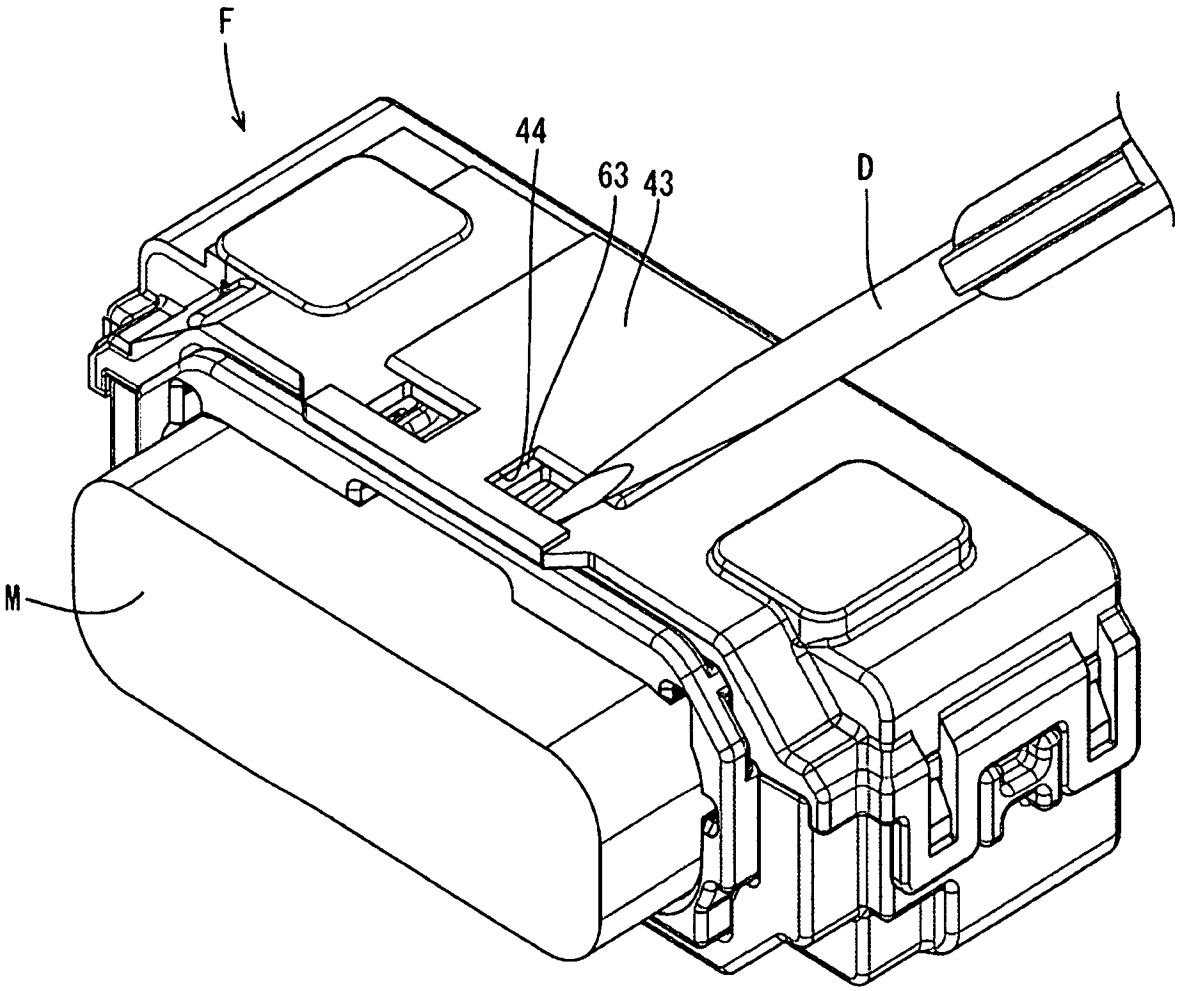
FIG. 11 is a view showing a state where a jig is being used.

The terminal accommodating portion 21 extends forward from the rear wall 23. A rear half part of the terminal accommodating portion 21 serves as a base 21A having a substantially rectangular parallelepiped shape and a front half part has accommodating protrusions 21B that are long in a front-rear direction. As shown in FIG. 10, the terminal accommodating portion 21 has cavities 21D that open forward and penetrate in the front-rear direction from the front ends of the respective accommodating protrusions 21B to the rear end of the rear wall 23. In this way, a female terminal FT connected to a wire W is insertable into each cavity 21D from behind.

As shown in FIG. 5, the rear receptacle 22 extends forward from a peripheral edge of the rear wall 23 and includes a second lock receiving groove 22A on an upper side of the terminal accommodating portion 21 and lock projection receiving grooves 22B on both left and right sides of the terminal accommodating portion 21. The second lock receiving groove 22A is formed by cutting an upper central part of the rear receptacle 22 and the rear wall 23 connected thereto in the front-rear direction. On the other hand, the lock projection receiving grooves 22B are formed by cutting both left and right sides of the rear receptacle 22 in the front-rear direction. Specifically, the rear receptacle 22 extends forward to surround the base 21A from a part of the upper edge excluding a central part, both upper and lower end parts of left and right side edges and the entire lower edge of the rear wall 23. A fitting space CL is formed between the rear receptacle 22 and the base 21A. The fitting space CL can receive the outer housing 30 and the mating housing M as described later.

As shown in FIG. 3, a sealing ring 70 made of a resilient material is fit on the rear end of the base 21A. The sealing ring 70 has a rectangular annular shape with four rounded corners to correspond to the base 21A, and is in contact with the base 21A over the entire periphery in a liquid-tight manner. Each of three lips 71, 71B is provided continuously in a circumferential direction on the outer peripheral surface of the sealing ring 70. Out of the three lips 71A, 71B, the middle one serves as a water stopping lip 71A, and two lips disposed on both sides of the middle one serve as mudguard lips 71B for isolating the water stopping lip 71A from foreign matter from outside. The mudguard lips 71B are shorter in height than the water stopping lip 71A and are inclined somewhat to the side of the water stopping lip 71A toward projecting ends. The mudguard lips 71B have a laterally unbalanced chevron-shaped vertical cross-section.

As shown in FIG. 3, the accommodating protrusions 21B are collectively covered with a front cap 80 having a wide and flat rectangular tube shape. A closing surface is provided on a front of the front cap 80 and is formed with male terminal insertion holes penetrating in the front-rear direction. As shown in FIG. 10, the front cap 80 is arranged such that an inner peripheral surface near a rear end is in contact with the outer peripheral surface of the base 21A and a rear end faces the front end of the sealing ring 70.

As shown in FIGS. 3 and 5, a right lock piece 51R and upper and lower right supports 52R are provided on a right side of the terminal accommodating portion 21 to form the first lock 50. Similarly, a left lock piece 51L and upper and lower left supports 52L are provided on a left side of the terminal accommodating portion 21 to form the first lock 50. The right lock piece 51R and the right supports 52R, and the left lock piece 51L and the left supports 52L are at bilaterally symmetrical positions with the terminal accommodating portion 21 as a center, and the configurations thereof are bilaterally symmetrical with respect to the terminal accommodating portion 21. Accordingly, only the right lock piece 51R and the right supporting portions 52R are described as representatives below. The left lock piece 51L and the left supports 52L are not described and are shown with a suffix R of the reference signs for the right lock piece 51L and the right supports 52L replaced by L. Further, in the following description, the right and left lock pieces 51L, 51R collectively may be called first lock pieces 51R, 51L.

As shown in FIGS. 4 and 5, the upper and lower right supports 52R bulge laterally from the rear receptacle 22 and are connected to upper and lower side walls of the lock projection receiving groove 22B. The right lock piece 51R is a flat strip-like small piece disposed between the right supports 52R, and extends parallel to a side wall of the terminal accommodating portion 21. The right lock piece 51R is coupled to the upper right support 52R at a position rearward of a center of the upper edge thereof, and is coupled to the lower right support 52R at a position rearward of a center of the lower edge thereof. The rear end of the right lock piece 51R is somewhat raised and serves as a right releasing portion 53R used by a worker to release the right lock piece 51R. A laterally penetrating right holding hole 54R is provided on a front side of the right lock piece 51R.

Figure 7:
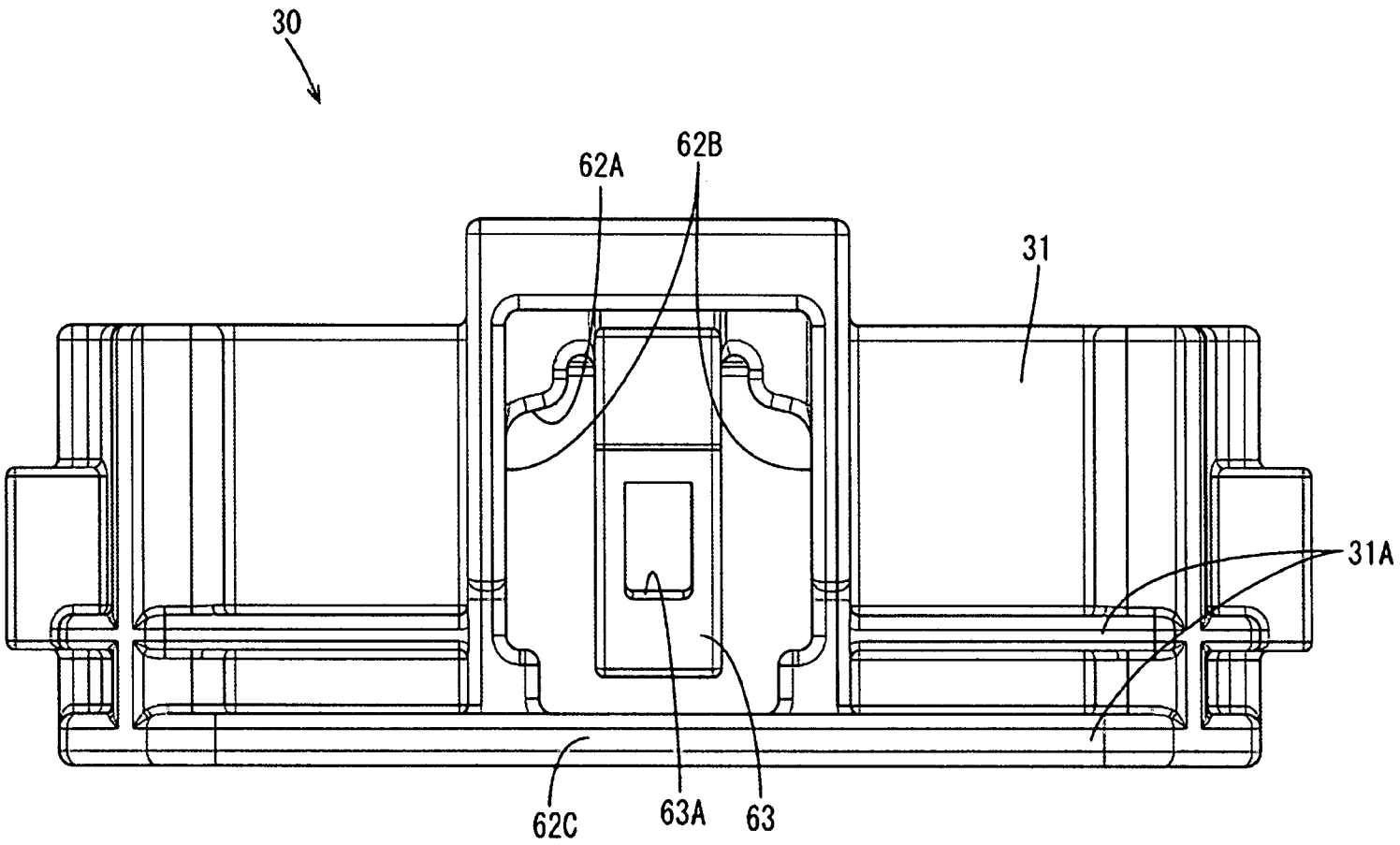
FIG. 7 is a plan view showing an outer housing.
Figure 8:
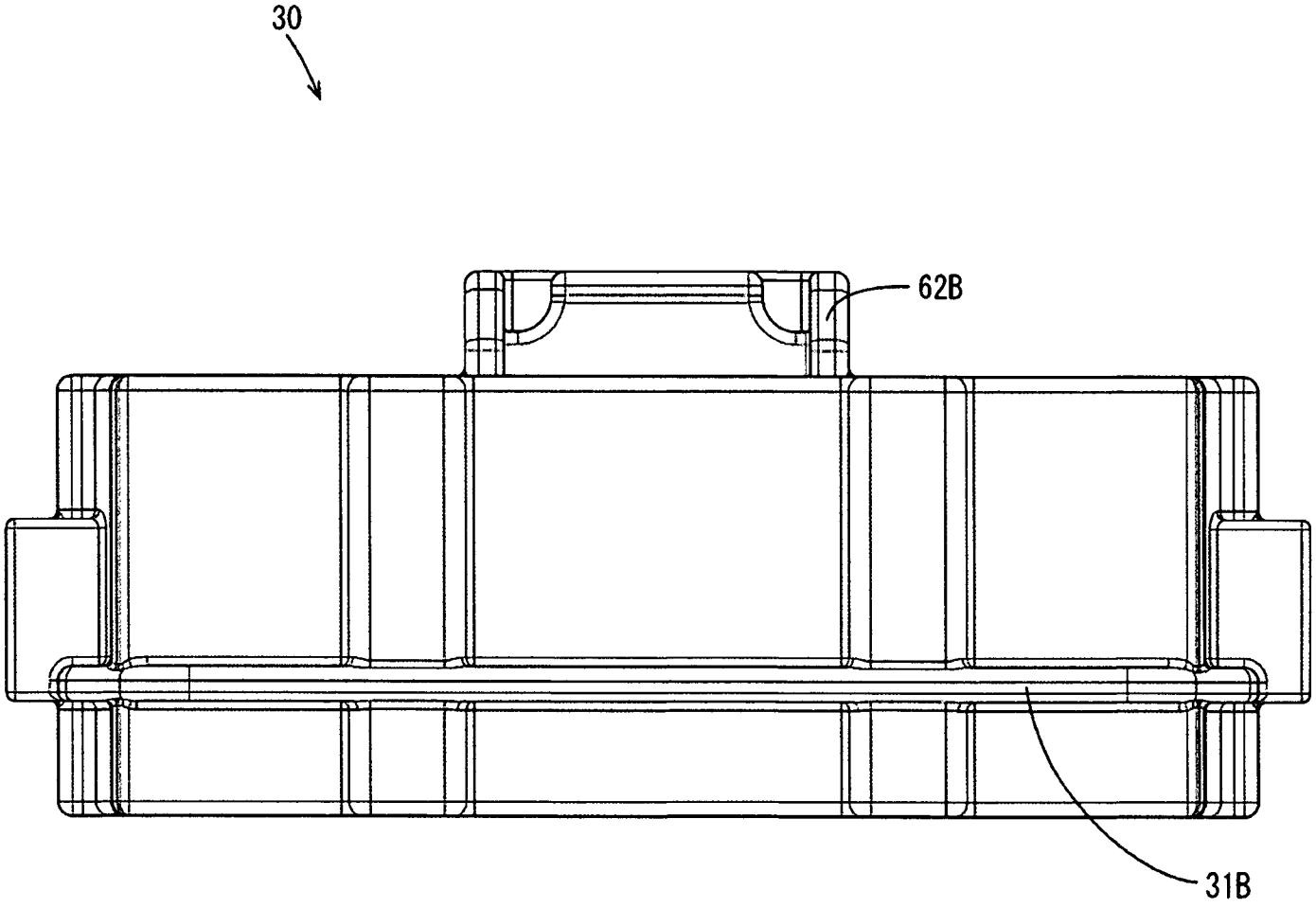
FIG. 8 is a bottom view showing the outer housing.

As shown in FIG. 3, the outer housing 30 includes a front receptacle 31 having a substantially rectangular tube shape and is to be arranged on an outer periphery of the terminal accommodating portion 21 of the inner housing 20. A right lock projection 55R and a left lock projection 55L constituting the first locks 50 are on an outer periphery of the front receptacle 31. As shown in FIGS. 3 and 7, front and rear upper surface ridges 31A project up and extend laterally on the front end of the upper surface of the front receptacle 31. As shown in FIG. 8, a lower surface ridge 31B projects down and extends laterally near the front end of the lower surface of the front receptacle 31.

The right lock projection 55R is provided at a position corresponding to the right holding hole 54R of the inner housing 20 when the outer housing 30 is mounted on the outer periphery of the inner housing 20, and projects rightward from a pedestal 55 provided on an outer side surface of the outer housing 30. The left lock projection 55L is provided at a position bilaterally symmetrical with the right lock projection 55R with the front receptacle 31 as a center, and projects leftward from a pedestal 55 of the outer housing 30.

Figure 9:
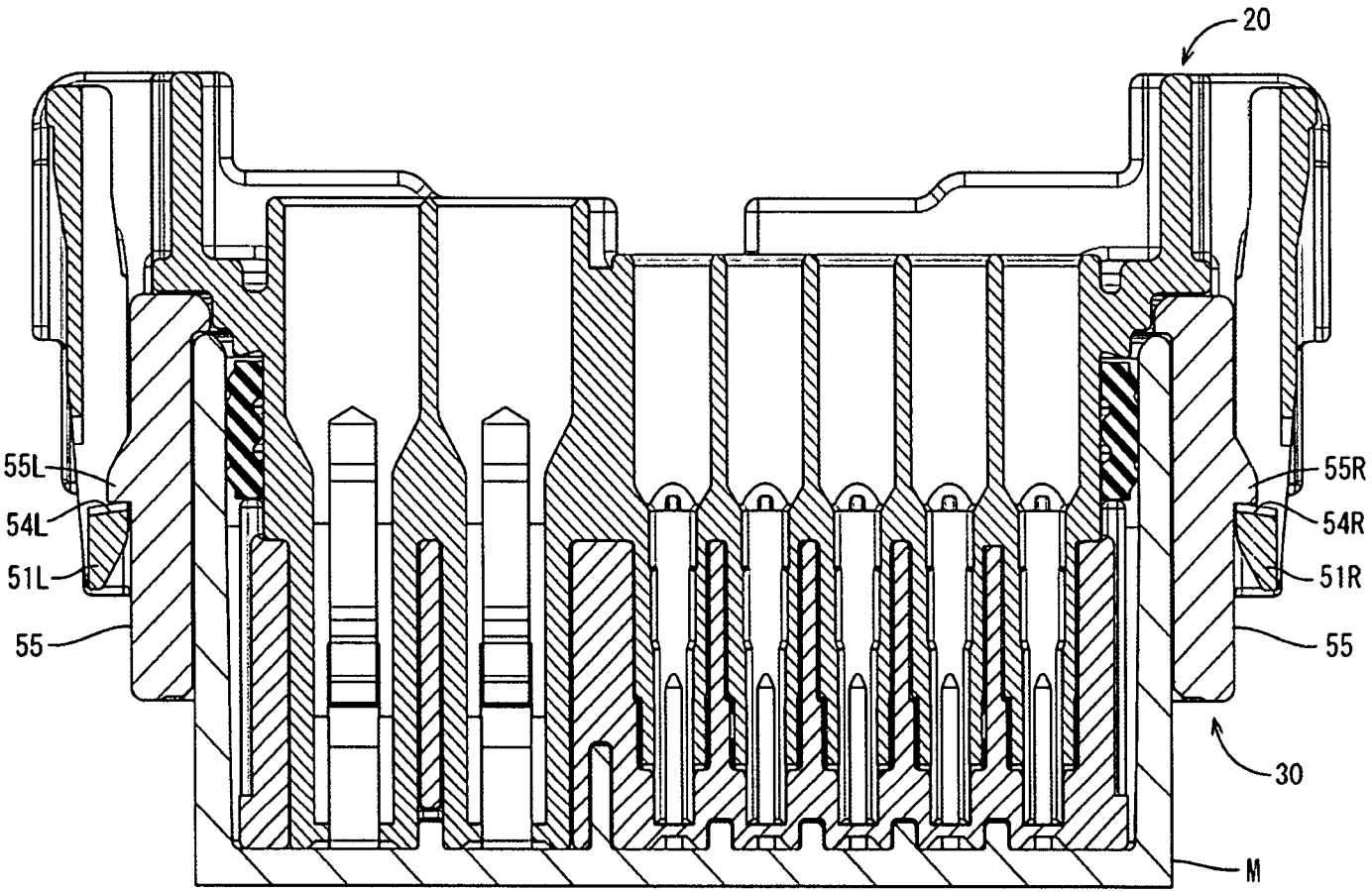
FIG. 9 is a section showing a state where a female housing and a mating housing are connected.

With the outer housing 30 mounted on the outer periphery of the inner housing 20, the first lock 50 is locked by fitting the right lock projection 55R into the right holding hole 54R of the right lock piece 51R provided on the inner housing 20, as shown in FIG. 9. In this way, the outer housing 30 and the inner housing 20 are held integrally. Simultaneously, the pedestal 55 is fit into the lock projection receiving groove 22B, thereby making it difficult for foreign matter to intrude into the rear receptacle 22 from the lock projection receiving groove 22B. Note that the first lock 50 can be released by pressing the right releasing portion 53R leftward (i.e. in a direction toward the rear wall 23) with a finger or the like, rotationally displacing the right holding hole 54R outwardly with the right supports 52R as a fulcrum and separating the right holding hole 54R from the right lock projection 55R.

As described above, the female connector 1 includes the inner housing 20 and the outer housing 30, and the inner housing 20 and the outer housing 30 are held integrally by the first locks 50. This female connector 1 also has a second lock 60 to be locked to a projection (hereinafter, referred to as a mating projection MP, see FIGS. 3 and 10) on the upper surface of the mating housing M. When the inner housing 20 is fit to an inner periphery of the mating housing M, the fit state is held by the second lock 60.

In this embodiment, the second lock 60 is provided on the front receptacle 31 of the outer housing 30 and, as shown in FIG. 7, is composed of an accommodation recess 62A, two accommodating walls 62B, a hand-touch restricting portion 62C and an upper lock piece 63.

The accommodation recess 62A vertically penetrates through the front receptacle 31 and is open forward. The accommodating walls 62B have a U-shape in a plan view to surround both sides and the rear end of the accommodation recess 62A, and constitute an inner wall of the accommodation recess 62A. The hand-touch restricting portion 62C is shaped to extend to close a front end opening between the accommodating walls 62B, and is U-shaped in a front view, as shown in FIG. 3.

The upper lock piece 63 is cantilevered toward a front end with the rear end of the accommodation recess 62A as a base. A through hole 63A vertically penetrates through a substantially central part of the upper lock piece 63.

With the outer housing 30 mounted on the inner housing 20, the second lock 60 is fit in the second lock receiving groove 22A of the rear receptacle 22, as shown in FIGS. 2 and 3. This makes it difficult for foreign matter to intrude into the rear receptacle 22 from the second lock receiving groove 22A.

When the mating housing M is connected to such a female connector 1, the second lock 60 is locked by fitting the mating projection MP into the through hole 63A, as shown in FIG. 10. Note that clearances between the upper lock piece 63 and the accommodating walls 62B, a clearance between the upper lock piece 63 and the hand-touch restricting portion 62C and a clearance between the hand-touch restricting portion 62C and the mating housing M are sufficiently narrow so that a finger cannot be inserted. Thus, the second lock 60 can be released only by inserting a jig D, such as a driver, below the upper lock piece 63 through these clearances to lift the upper lock piece 63 and separating the through hole 63A from the mating projection MP.

As shown in FIG. 2, the cover 40 includes a cover body 40A for covering the female housing F from above and a cover receiving portion 40B for covering the female housing F from both sides and below. The cover body 40A and the cover receiving portion 40B are held integrally by a cover lock 41.

As shown in FIG. 2, the cover body 40A includes a ceiling wall 45 having a substantially plate-like shape, an upper front frame portion 46A, left and right upper side wall portions 47A and cover lock pieces 41A constituting the cover lock 41. The upper front frame portion 46A projects down from the front end of the ceiling wall 45 and extends laterally. The upper side wall portions 47A extend down from both sides of the ceiling wall 45. The cover lock pieces 41A extend down from the respective upper side wall portions 47A. Each cover lock piece 41A is formed with a cover lock hole 41B penetrating in the lateral direction.

The cover receiving portion 40B includes a bottom wall 48 having a substantially plate-like shape, front and rear lower front frame portions 46B, left and right lower side wall portions 47B and cover lock projections 41C constituting the cover lock 41. The lower front frame portions 46B project up from the front end of the bottom wall 48 and extend laterally. The lower side wall portions 47B extend up from both side ends of the bottom wall 48. The cover lock projections 41C project laterally out from the respective lower side wall portions 47B.

With the cover 40 mounted on the female housing F, the upper front frame portion 46A of the cover body 40A is fit between the upper ridges 31A of the outer housing 30 and, as shown in FIG. 1, the lower front frame portions 46B of the cover receiving portion 40B are disposed before and after the lower ridge 31B of the outer housing 30. In this way, a relative displacement of the cover 40 in the front-rear direction with respect to the female housing F is restricted and foreign matter is less likely to intrude from the front of the cover 40 due to a labyrinth structure. This mounted state is held by the locking of the cover lock 41 in which the respective cover lock projections 41C are fit into the cover lock holes 41B. The cover lock 41 can be released by displacing the respective cover lock pieces 41A laterally outward with fingers or the like and separating the respective cover lock holes 41B from the respective cover lock projections 41C.

With the cover 40 mounted on the female housing F, the cover 40 covers the entire left and right first locks 50 from laterally outer sides by the upper side wall portions 47A and the lower side wall portions 47B and covers the entire second lock 60 from above by a central part 43 of the ceiling wall 45. In this way, the first locks 50 and the second lock 60 cannot be hand-touched from outside. Note that a part of the cover body 40A covering the second lock 60 from above is referred to as a closing portion 43. Further, two releasing holes 44 vertically penetrate near the front end of the ceiling wall 45. Each releasing hole 44 is sized so that the jig D, such as a driver, is insertable, and enables the jig D to be inserted into the clearance between the upper lock piece 63 and the accommodating wall 62B. In this way, in the case of inserting the jig D through the releasing hole 44, the tip of the jig D is inserted below the upper lock piece 63 to perform a releasing operation.

Further, the respective holding holes 54R, 54L of the first locks 50 and the through hole 63A of the second lock 60 possibly serve as routes for short-circuiting a distance to the sealing ring 70 from outside. To deal with this, the first locks 50 and the second lock 60 are covered with the cover 40 in this embodiment. In this way, routes to the sealing ring 70 from the respective holding holes 54R, 54L and the through hole 63A are eliminated, and a route to the sealing ring 70 from the front of the cover 40 also is made complicated by a labyrinth structure.

Next, how to use the female connector 1 of this embodiment is illustrated.

First, prior to connection to the mating housing M, the outer housing 30 is mounted on the terminal accommodating portion 21 of the inner housing 20 from the front, and the first locks 50 are locked. The cover 40 is mounted on the inner housing 20 and the outer housing 30 from above and below, and the cover lock 41 is locked to form the female connector 1 in which the inner housing 20, the outer housing 30 and the cover 40 are held integrally.

In the case of connecting this female connector 1 to the mating housing M, the mating housing M is inserted to a back side of the fitting space CL through a clearance between the front cap 80 of the inner housing 20 and the front receptacle 31 of the outer housing 30. The mating housing M then is inserted until the rear end thereof contacts or is immediately facing the rear wall 23 while the inner peripheral surface thereof slides in contact with the three lips 71A, 71B of the sealing ring 70, and the unillustrated mating terminals and the female terminals FT are conductively connected. Along with this, the mating projection MP is fit into the through hole 63A of the outer housing 30 and the second lock 60 is locked. In this way, the mating housing M and the female connector 1 are connected, and held in a connected state shown in FIG. 1 by the second lock 60.

If it becomes necessary to remove the female connector 1 from the mating housing M before the start of use in an environment, in which foreign matters are present, after the mating housing M is connected, the jig D is inserted through the releasing hole 44 of the cover 40 and the tip thereof is inserted below the upper lock piece 63 of the outer housing 30 to lift the upper lock piece 63, as shown in FIG. 1. Then, the locking of the upper surface side lock piece 63 and the mating projection MP is released, and the entire female connector 1 can be pulled out rearward from the mating housing M.

On the other hand, if maintenance, for example, for the female terminals FT becomes necessary in a state where the female connector 1 and the mating housing M are used in an environment in which foreign matter is present, and the foreign matter adheres to the outer surfaces of the female connector 1 and the mating housing M after the mating housing M is connected, the cover lock 41 is first released and the cover 40 adhered with a large amount of the foreign matter is removed. The left and right releasing portions 53R, 53L of the first locks 50 are pressed toward each other with fingers so that the first locks 50 are released. In this way, only the inner housing 20 having no foreign matter adhered thereto is pulled out rearward from the mating housing M with the outer housing 30 having a small amount of the foreign matter adhered thereto kept locked to the outer periphery of the mating housing M by the second lock 60 (i.e. state shown in FIG. 3 is set).

By the above configuration, the connector (female connector 1) includes the inner housing 20 to be fit to the inner periphery of the mating housing M and the outer housing 30 fittable to the outer peripheral side of the mating housing M. The outer housing 30 is held on the inner housing 20 by the first locks 50 before connection to the mating housing M, is held connected to the mating housing M by the second lock 60 at the time of connection to the mating housing M, and is separated from the inner housing 20 and held connected to the mating housing M by releasing the first locks 50 at the time of separation from the mating housing M.

If the outer housing 30 is separated from the mating housing M, foreign matter adheres to a fitting part of the outer housing 30 and the mating housing M. Thus, a connection force increases when connecting the outer housing 30 and the mating housing M again. However, the outer housing 30 is kept connected to the mating housing M according to the above configuration to prevent the adhesion of foreign matter that would otherwise cause an increase of the connection force.

Further, the inner housing 20 is fit to the inner peripheral side of the mating housing M while being isolated from outside by both the mating housing M and the outer housing 30 fit to the outer periphery of the mating housing M. Thus, even if foreign matter is not adhering to the inner housing 20 (unlike the outer housing 30) and only the inner housing 20 is removed from the inner periphery of the mating housing M for maintenance or the like, the foreign matter is unlikely to adhere to the inner housing 20. Therefore, the insertion and removal of the inner housing 20 into and from the mating housing M can be repeated while suppressing the adhesion of foreign matter to the inner housing 20 and preventing an increase of a connection force.

Further, the inner housing 20 includes the terminal accommodating portion 21. that is to be fit to the inner periphery of the mating housing M. The sealing ring 70 is provided on the outer periphery of the terminal accommodating portion 21 and contacts the inner periphery of the mating housing M when the terminal accommodating portion 21 is fit to the inner periphery of the mating housing M. Additionally, the rear wall 23 is coupled to the terminal accommodating portion 21 and is disposed outside the mating housing M. Accordingly, the outer housing 30 collectively covers the mating housing M and the rear wall 23.

According to this configuration, since the outer housing 30 collectively covers the mating housing M and the base 21A of the inner housing 20 disposed outside the mating housing M, a route of foreign matter from outside to the sealing ring 70 through the clearance between the mating housing M and the base 21A becomes longer and the amount of the foreign matter accumulated near the sealing ring 70 can be reduced.

Further, the cover 40 collectively covers the inner housing 20 and the outer housing 30. The second lock 60 includes the through hole 63A provided on a side of the outer housing 30 forward of the sealing ring 70 in a connecting direction to the mating housing M and capable of locking the mating housing M. The cover 40 includes the ceiling wall 45 having the closing portion 43 for covering the through hole 63A and the releasing holes 44 that penetrate through the ceiling wall 45 forward of the closing portion 43 in the connecting direction and enabling the locking of the mating housing M and the through hole 63A to be released. According to this configuration, the through hole 63A of the second lock 60 is covered by the closing portion 43 of the cover 40 and cannot be hand-touched from outside. Thus, the second lock 60 cannot be unlocked inadvertently. Further, since the through hole 63A is covered by the closing portion 43, there is no route of foreign matter from outside to intrude to the sealing ring 70 from the through hole 63A, and the amount of the foreign matter accumulated near the sealing ring 70 can be further reduced. Further, the releasing holes 44 enabling the locking with the mating housing M to be released are forward of the closing portion 43 in the connecting direction. Therefore, even if foreign matter intrudes through the releasing holes 44 from outside, the intrusion of the foreign matter can be suppressed since a route to the sealing ring 70 becomes longer.

Further, the first locks 50 are covered with the cover 40.

Second Embodiment

Figure 12:
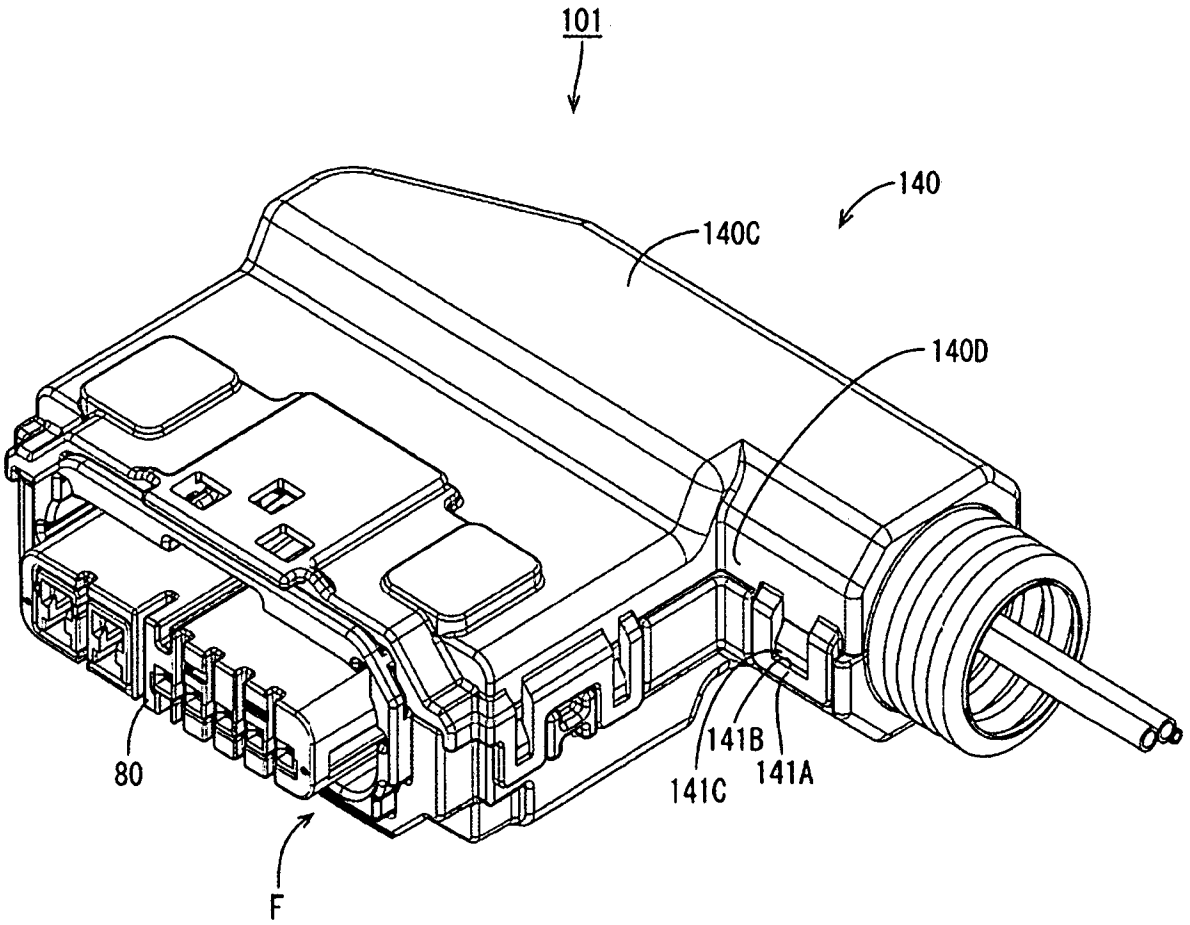
FIG. 12 is a perspective view showing a connector according to a second embodiment.

Next, a second embodiment according is described with reference to FIG. 12.

In a female connector 101 of the second embodiment, an upper back wall 140C and a lower back wall 140D are added to the cover 40 of the first embodiment to form a cover 140. Components corresponding to those of the first embodiment are denoted by reference sings obtained by adding 100 to those of the first embodiment. The same components, functions and effects as those of the first embodiment are not described and the same components as those of the first embodiment are denoted by the same reference signs.

The upper back wall 140C and the lower back wall 140D are formed integrally to a cover body 40A and a cover receiving portion 40B, and cover unillustrated wires extending from the back surface of a female housing F over a predetermined length.

The upper back wall 140C is provided with a cover lock piece 141A similar to the cover lock piece 41A of the cover body 40A, and the lower back wall 140D is provided with a cover lock projection 141C similar to the cover lock projection 41C of the cover receiving portion 40B. With the cover 140 mounted on the female housing F, the cover lock projection 141C is locked into a cover lock hole 141B of the cover lock piece 141A so that the upper back wall 140C and the lower back wall 140D are held integrally. In this way, a route from an end of the cover member 140 to a sealing ring 70 can be made longer.

Other Embodiments

The invention is not limited to the above described and illustrated embodiments. For example, the following embodiments can be employed.

Although the sealing ring 70 is provided on the inner housing 20 in the first and second embodiments, a sealing ring may be provided on an inner peripheral surface of a mating housing. Alternatively, in the case of use in an environment with less foreign matter, a sealing ring may not be provided.

Although the female connector 1, 101 includes the cover 40, 140 in the first and second embodiments, a cover may not be provided in the case of use in an environment with less foreign matters.

(3) Although the first locks 50 are covered entirely with the cover 140 and cannot be hand-touched in the first and second embodiments, an operating portion may project rearward from the cover, for example, in the first embodiment. This enables only the inner housing to be removed from the mating housing by pinching the operating portion with fingers with the cover adhered with a large amount of foreign matter held on the mating housing together with the outer housing without being removed.

LIST OF REFERENCE SIGNS

1: female connector (connector)
20: inner housing
21: terminal accommodating portion
23: rear wall
30: outer housing
40: cover
45: ceiling wall
43: closing portion
44: releasing hole
50: first lock
60: second lock
63A: through hole
70: sealing ring
M: mating housing

The invention claimed is:

1. A connector, comprising:

an inner housing to be fit to an inner periphery of a mating housing;

an outer housing fittable to an outer periphery of the mating housing; and a cover for collectively covering the inner housing and the outer housing, wherein:

the outer housing includes a first lock that holds the outer housing on the inner housing before connection to the mating housing, the outer housing includes a second lock having a through hole capable of being held connected to the mating housing upon connection of the outer housing to the mating housing, and the outer housing is separated from the inner housing and held connected to the mating housing by releasing the first lock to enable separation of the inner housing from both the outer housing and the mating housing, and the cover includes a ceiling wall having a closing portion for covering the through hole of the second lock and a releasing hole penetrating through the ceiling wall forward of the closing portion in the connecting direction and enabling locking between the mating housing and the through hole to be released thereby enabling separation of the inner housing, the outer housing and the cover from the mating housing.

2. The connector of claim 1, wherein the first lock is covered by the cover.

3. The connector of claim 1, further comprising:

a rear wall coupled to the terminal accommodating portion and to be disposed outside the mating housing, and the outer housing collectively covers the mating housing and the rear wall.

4. The connector of claim 1, wherein:

the inner housing includes a terminal accommodating portion with an outer periphery and having a sealing ring provided on the outer periphery of the terminal accommodating portion, the seal ring being capable of contacting an inner periphery of the mating housing when the terminal accommodating portion is fit to the inner periphery of the mating housing.

5. The connector of claim 4, wherein the first lock is covered by the cover.

6. The connector of claim 4, further comprising:

a rear wall coupled to the terminal accommodating portion and to be disposed outside the mating housing, and the outer housing collectively covers the mating housing and the rear wall.

* * * * *